US007867452B2

(12) United States Patent
Hochstrasser et al.

(10) Patent No.: US 7,867,452 B2
(45) Date of Patent: Jan. 11, 2011

(54) MULTI-WELL FILTRATION DEVICE

(75) Inventors: Remo Anton Hochstrasser, Oberwil (CH); Dieter Voegelin, Sissach (CH); Urs Schwitter, Reinach (CH); Pirmin Hidber, Basel (CH)

(73) Assignee: F. Hoffmann-La Roche AG, Basel (CH)

( * ) Notice: Subject to any disclaimer, the term of this patent is extended or adjusted under 35 U.S.C. 154(b) by 0 days.

(21) Appl. No.: 11/801,661

(22) Filed: May 9, 2007

(65) Prior Publication Data

US 2007/0264163 A1 Nov. 15, 2007

(30) Foreign Application Priority Data

May 12, 2006 (EP) ..... 06405198

(51) Int. Cl.
*B01L 11/00* (2006.01)

(52) U.S. Cl. ..... 422/101

(58) Field of Classification Search ..... 422/101
See application file for complete search history.

(56) References Cited

U.S. PATENT DOCUMENTS

| | | | | |
|---|---|---|---|---|
| 5,674,395 | A * | 10/1997 | Stankowski et al. | 210/321.75 |
| 5,888,831 | A * | 3/1999 | Gautsch | 436/177 |
| 5,958,714 | A * | 9/1999 | Gordon et al. | 435/7.92 |
| 6,750,064 | B2 * | 6/2004 | Stahly et al. | 436/181 |
| 2001/0039058 | A1 * | 11/2001 | Iheme et al. | 436/180 |
| 2003/0116497 | A1 * | 6/2003 | Carlson et al. | 210/435 |
| 2003/0143124 | A1 | 7/2003 | Roberts et al. | 422/102 |
| 2003/0215956 | A1 | 11/2003 | Reed | 436/174 |

FOREIGN PATENT DOCUMENTS

| | | | |
|---|---|---|---|
| EP | 1477812 | | 11/2004 |
| EP | 1854542 | A1 * | 11/2007 |
| GB | 2246081 | A * | 1/1992 |
| WO | WO 98/35013 | | 8/1998 |
| WO | WO 0119520 | A1 * | 3/2001 |

OTHER PUBLICATIONS

The definition of Merriam-Webster's Dictionary for filter. Date: Jun. 17, 2010.*

European Search Report No. EP 06405198.0, date of completion of search Nov. 15, 2006.

European Search Report of EP 7107643, mailed on Sep. 4, 2007, 2 pages.

* cited by examiner

*Primary Examiner*—Walter D Griffin
*Assistant Examiner*—Bobby Ramdhanie
(74) *Attorney, Agent, or Firm*—Mintz, Levin, Cohn, Ferris, Glovsky and Popeo, P.C.

(57) ABSTRACT

A multi-well filtration device for filtering a suspension comprises a filtration plate with a filtration chamber and a collecting plate with a collecting well. The filtration chamber is connected to the collecting well and a filter element is arranged between the filtration chamber and the collecting well. A separation layer is arranged between the filtration plate and the collecting plate adjacent to the filter element. The use such of a separation layer allows an easy detachment of the filtration plate from the collecting plate. The detached filtration plate can comfortably be transferred into an analysis device, in which the solid phase of the filtration chamber can separately be analyzed through the separation layer, without any replacement of the solid phase.

8 Claims, 4 Drawing Sheets

MULTI-WELL FILTRATION DEVICE

TECHNICAL FIELD

The present invention relates to a multi-well filtration device for filtering a suspension in general and more particularly to a system and a method for analyzing the solid phase of a suspension.

BACKGROUND ART

Particularly in pharmaceutical industry, various industrial processes and research processes for creating certain chemical compounds involve suspensions. Suspensions basically comprise a solid phase and a liquid phase wherein the liquid phase can e.g. be a solution comprising a solute dissolved in a solvent. In order to be able to dissolve a favourable amount of solute, the solution is often equilibrated at an elevated temperature close to the boiling point of the solvent. For receiving the solution with less solid phase, needed by following process steps, at a certain stage of the above mentioned processes, the suspension is often separated into the solid phase, i.e. crystals or other solids, and into the solution.

One prevalent kind of such separation of the suspension is filtration. In known filtration devices, frequently the suspension is forced through a filter by means of underpressure applied on that side of the filter facing away of the suspension. The underpressure drives the suspension through the filter. The filter holds back the solid phase up to a certain extent, thus forming a filter cake. A side effect of such filtration can be that said underpressure causes crystal formation of the solution and therefore lowers the amount of solute dissolved in the solvent. In addition, the temperature of the solution is often lowered by such filtration, again causing crystal formation in the solution and lowering the amount of solute dissolved in the solvent.

Particularly in research processes, the use of standardized microplates having a plurality of wells is common. For example, these microplates are standardized in terms of footprint dimensions, height dimensions, bottom outside flange dimensions and well positions. Commonly used standardized microplates comprise 96, 384 or 1536 wells.

Furthermore, again particularly in research processes, the analysis of the above mentioned solid phase, i.e. crystals or other solids, has become more and more important, e.g. to get a deeper understanding and a better control of the chemical processes and of the polymorphic forms of chemical compounds. Such analysis is preferably performed by methods like X-ray powder diffraction (XRPD) or infrared and raman spectroscopy. To be able to perform said methods the crystals and solids usually have to be removed from the filtration device and be transferred into specific analysis devices, which can be a quite delicate cumbersome task.

Therefore there is a need for the provision of a microplate-standard compliant device being capable of separating the solid phase from the liquid phase of a suspension providing the solid phase in a manner which is easily accessible for further processing, e.g. analysis.

DISCLOSURE OF THE INVENTION

According to the invention, the need for the provision of a microplate-standard compliant device being capable of separating the solid phase from the liquid phase of a suspension providing the solid phase in a manner which is easily accessible for further processing is settled by a multi-well filtration device for filtering a suspension, and by a system and a method for analyzing the solid phase of a suspension.

In particular, the invention deals with a multi-well filtration device for filtering a suspension, comprising a filtration plate with a filtration chamber and a collecting plate with a collecting well. The filtration chamber is connected to the collecting well and a filter element is arranged between the filtration chamber and the collecting well. Further, a separation layer is arranged between the filtration plate and the collecting plate adjacent to the filter element.

The use of a separation layer allows an easy detachment of the filtration plate from the collecting plate. Particularly, if multiple filtration chambers are arranged in one single filtration plate, the separation layer ensures that the solid phase of each filtration chamber is kept separated from the solid phase of the other filtration chambers. Further, the detached filtration plate can comfortably be transferred into an analysis device, in which the solid phase of each filtration chamber can separately be analyzed through the separation layer, without removing the solid phase. Using the filtration device according to the invention, the solid phase (filter cake) of the filtration process can be analyzed without any further conditioning of the solid phase.

Preferably, the pore size of the filter element is about 1 μm to about 2 μm.

In a preferred embodiment the separation layer is transparent, wherein transparency relates to methods suitable for the analysis of the solid phase of a suspension, i.e. crystals or other solids. In particular, it relates to methods for the analysis of crystallized polymorphic forms of chemical compounds. Preferably, such methods are methods such as X-ray powder diffraction or infrared and Raman spectroscopy. In these cases transparent means either transparent for X-ray, for infrared light or for laser beam. Thus, the separation layer preferably is made of an amorphous fluoropolymer, in particular of an amorphous fluoropolymer as it is known by persons skilled in the art as Teflon AF.

Preferably, the filter element has passages and the separation layer has holes in an area being in contact with the filter element, said holes having a diameter larger than the diameter of the passages of the filter element. Such arrangement provides a two stage filtration structure. On one stage the filtration effect is regulated by the passages of the filter element, wherein a filter cake is built during filtration. On the second stage the filter cake is held back by the separation layer inside the corresponding filtration chamber, wherein the size of the holes have to be adapted to be able to hold back the filter cake without substantially effecting the filtration.

In a preferred embodiment of the multi-well filtration device, the collecting well has an elongated cross-section and the deepest point of the collecting well is arranged at one longitudinal end region of the elongated cross-section. Elongated cross-section in the sense of the invention comprises all geometrical forms being suitable for the use as described below. In particular it comprises oval forms and forms of rounded rectangles suitable to gather two wells, which are arranged in a standardized microplate structure having 96, 384 or 1536 wells.

One advantage of the elongated cross-section is that supply of the suspension and extraction of the filtrate by according supply and extraction means is easily possible in each single collecting well, wherein a compact arrangement is possible. Particularly, if multiple collecting wells are arranged in one collecting plate, for example suitable for a standardized microplate comprising 96, 384 or 1536 wells, such compact arrangement can be essential. To lower the dead volume of the filtrate in the collecting well and to allow a more or less complete extraction of the filtrate out of the collecting well, the bottom of the collecting well can be slightly slanted and well rounded, such that the deepest point of the collecting well is arranged at one longitudinal end region of the elongated cross-section being accessible to extraction means.

Preferably, the multi-well filtration device further comprises a lower funnel plate which is arranged between the filtration plate and the collecting plate. The lower funnel plate has a filtrate funnel connecting the filtration chamber with the collecting well and the filter element is arranged at the top of the filtrate funnel. The filter element is thereby arranged beneath the separation layer such that it remains on the lower funnel plate being connected to the collecting plate when the filtration plate is detached and transferred. Preferably, the filter element is arranged as a round metal mesh being inserted into a widened top part of the filtrate funnel and being compressed with the widened top part of the corresponding filtrate funnel. Also, the metal mesh is preferably reversed around the filtrate funnel at its lateral end section such that the metal mesh is press fitted with the lower funnel plate.

Further, the multi-well filtration device preferably comprises an upper funnel plate with a bridging channel, wherein the filtration plate has a through hole for extraction which is connected to the collecting well. The bridging channel extends through the through hole for extraction into the collecting well, such that the upper funnel plate is connected with the collecting plate via the bridging channel. With such a bridging channel, extraction means, e.g. an extraction needle, can easily be brought into the multi-well filtration device for extracting the filtrate. Since the bridging channel extends directly into the collecting well, no additional sealing means have to be arranged between the upper funnel plate and the collecting plate.

In a preferred embodiment, the multi-well filtration device further comprises a top plate with a needle funnel, and a pierceable septum with a septum opening. The septum is arranged between the top plate and the upper funnel plate or the filtration plate, respectively, such that the needle funnel is connected to the filtration chamber and that the septum opening is arranged adjacent to the needle funnel. In use, supply means, as e.g. a supply needle, can be inserted through the septum opening of the septum into the upper part of the filtration chamber. The suspension can then be filled into the filtration chamber on an elevated pressure level driving the suspension through the filter element into the collecting well. For creating said elevated pressure level, the supply means can be provided with overpressure means. While being arranged through the septum opening, the supply means are tightly connected to the septum.

Additionally the top plate can comprise a second needle funnel connected to the bridging channel of the upper funnel plate. In use, extraction means, as e.g. an extraction needle, can be inserted through a further septum opening of the septum into the collecting well allowing the filtrate to be extracted from the collecting well.

The top plate can have a recess around the needle funnel on the side facing the septum and the upper funnel plate or the filtration plate, respectively, can have a corresponding ridge on the side facing the septum, such that the septum is pressed into the recess by the ridge. It is obvious to a person skilled in the art that the arrangement of the recess and the ridge can as well be vice versa, i.e. the top plate having the ridge and the upper funnel plate or the filtration plate, respectively, having the recess. With such an arrangement, it is possible to ensure a tight connection between the septum and its adjacent layers in its essential region, i.e. around the needle funnel, such that it is possible to provide an elevated pressure in the filtration chamber.

In a preferred embodiment, the multi-well filtration device further comprises a pressure equalization channel for equalizing the pressure in the collecting well, such that the supply of the suspension into the filtration chamber is not obstructed by an increasing pressure in the collecting well. In case that the multi-well filtration device has an upper funnel plate with a bridging channel and a through hole being connected to the filtration chamber, the pressure equalization channel can easily be arranged between said bridging channel and said through hole.

Preferably a sealing mat is arranged between two adjacent plates, said sealing mat having a hole located corresponding to adjacent openings of the two plates. One of said two plates has a sealing ridge on the side facing the sealing mat capable of receiving the border of the hole on top of the sealing ridge. With such an arrangement planar sealing mats can be used ensuring sufficient sealing effect around the hole.

A second aspect of the invention deals with a system for analyzing the solid phase of a suspension, comprising the multi-well filtration device described above. The system further comprises a supply needle for supplying the suspension into the filter chamber on an elevated pressure level and an extraction needle for extracting the filtrate out of the collecting well. Still further, it comprises an analysis device arranged for analyzing the solid phase filtered by the multi-well filtration device through the separation layer, while the solid phase is situated in the filtration chamber. Preferably, the separation layer is transparent as described above. Such a system enables an efficient analysis procedure of the solid phase of a suspension being filtered in a multi-well filtration device.

Preferably, the supply needle has a longitudinal groove for performing equalization of pressure while the supply needle is supplying the suspension into the filter chamber. Such a groove can be connected to pressure equalization means of the multi-well filtration device, e.g. a pressure equalization channel, such that the pressure in the collecting well and the filtration chamber can easily be equalized.

A third aspect of the invention deals with a method for analyzing the solid phase of a suspension by means of a system described above. The method comprises the steps of: supplying the suspension into the filter chamber on an elevated pressure level by means of the supply needle and thereby driving the suspension through the filter element into the collecting well; removing the filtration plate together with the separation layer from the collecting plate; transferring the filtration plate to the analysis device; and analyzing the solid phase through the transparent separation layer. Such a method enables an efficient analysis of the solid phase of a suspension being filtered in a multi-well filtration device.

BRIEF DESCRIPTION OF THE DRAWINGS

The multi-well filtration device according to the invention is described in more detail hereinbelow by way of an exemplary embodiment and with reference to the attached drawings, in which.

BEST MODE FOR CARRYING OUT THE INVENTION

In the following description certain terms are used for reasons of convenience and are not to be interpreted as limiting. The terms "right", "left", "under" and "above" refer to directions in the figures. The terminology comprises the explicitly mentioned terms as well as their derivations and terms with a similar meaning.

Figure 1:
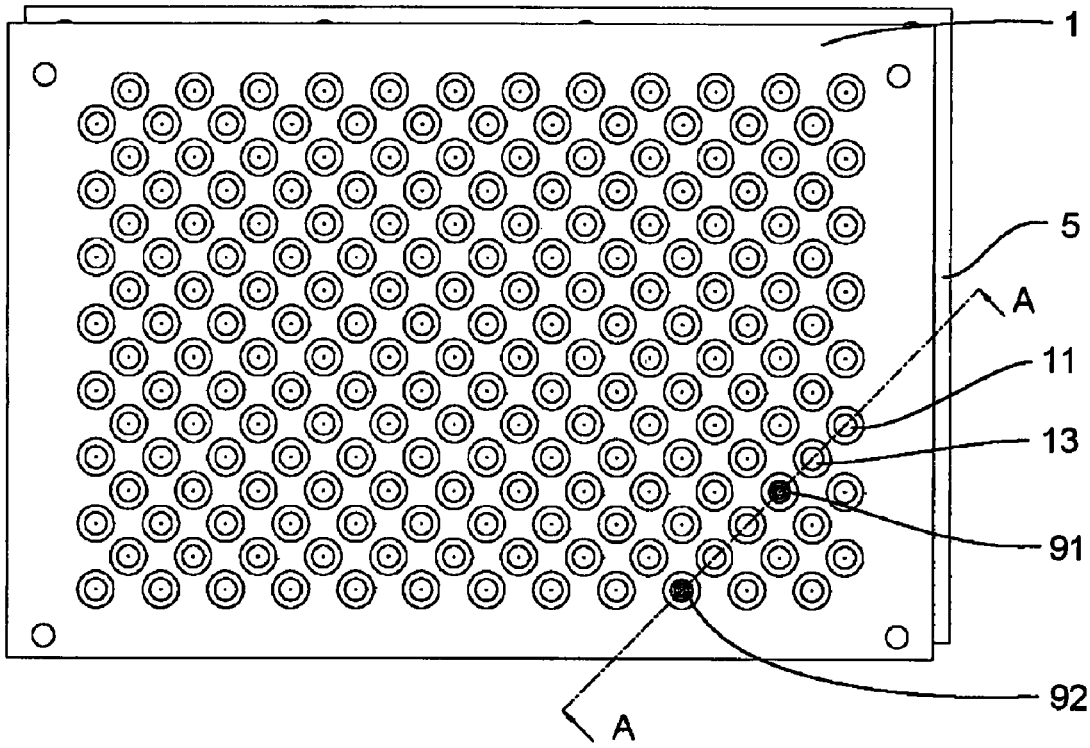
FIG. 1 shows a top view on a multi-well filtration device according to the invention.
Figure 2:
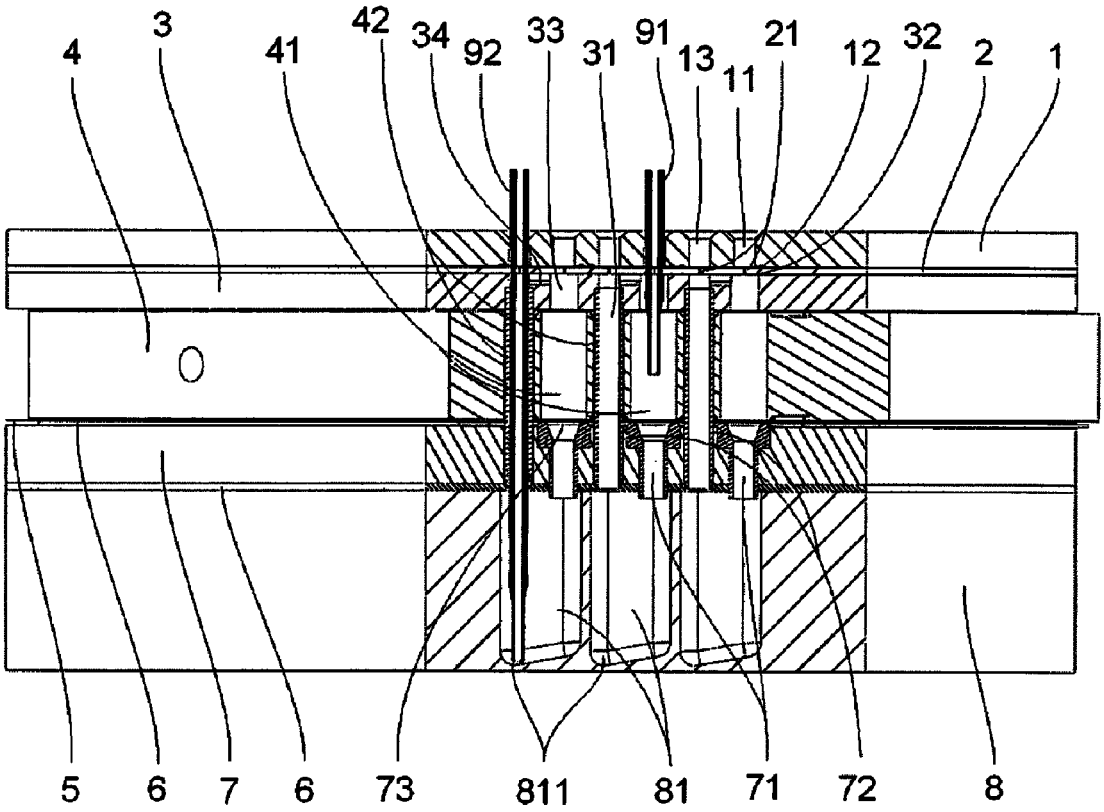
FIG. 2 shows a cross-section view along the line A-A of the multi-well filtration device from FIG. 1.
Figure 3:
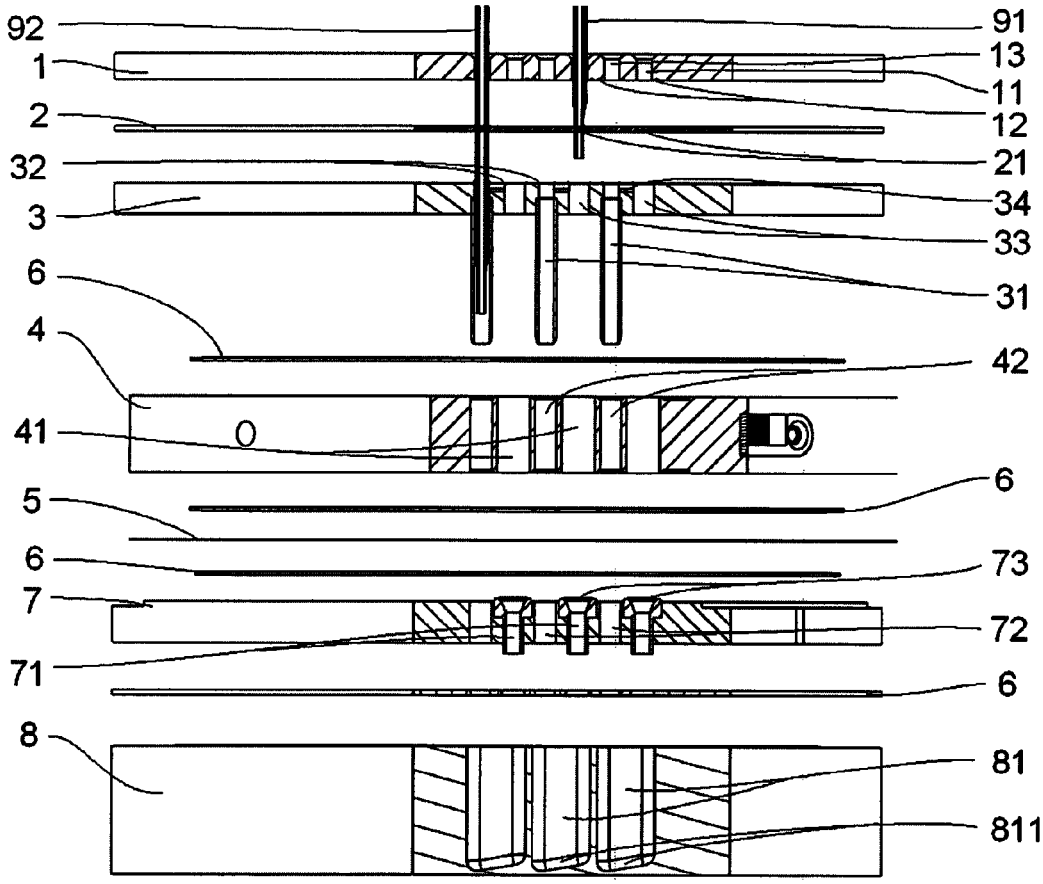
FIG. 3 shows an exploded view of the cross-section view from FIG. 2.

FIG. 1 shows a top view on a top plate 1 of a multi-well filtration device according to the present invention. The top plate 1 comprises 96 needle funnels for supply 11 and 96 needle funnels for extraction 13. Exemplary, one of the needle funnels for supply 11 is equipped with a supply needle 91 and one of the needle funnels for extraction 13 is equipped with an extraction needle 92. In FIG. 1, at the right hand side and at the above side of the top plate 1 the top side of a filtration plate 4 is visible. The filtration plate 4 is arranged below the top plate 1 as shown in FIG. 2 and FIG. 3. The top plate 1, the needle funnels for supply 11 and the needle funnels for extraction 13 are arranged in a standardized 96 wells microplate compliant structure.

In general, standardized microplate compliant structures allow the use of the multi-well filtration device in a standardized infrastructure. In particular, standardized liquid handling and analysis devices can be used.

The following applies to the rest of this description. If, in order to clarify the drawings, a figure contains reference signs which are not explained in the directly associated part of the description, then it is referred to previous description parts.

FIG. 2 and FIG. 3 show a cross-sectional view or an exploded cross-sectional view, respectively, of the multi-well filtration device along the line A-A of FIG. 1. In addition to the top plate 1 visible in FIG. 1, the multi-well filtration device comprises a septum 2 being arranged between an upper funnel plate 3 and the top plate 1. The upper funnel plate 3 is followed from top to bottom by: a first sealing mat 6; a filtration plate 4; a second sealing mat 6; a transparent separation layer 5; a third sealing mat 6; a lower funnel plate 7; a fourth sealing mat 6; and a collecting plate 8.

The upper funnel plate 3 has alternatingly arranged through holes for supply 33 and bridging channels 31 being interconnected by pressure equalization channels 34. Each through hole for supply 33 of the upper funnel plate 3 is connected to one of the needle funnels for supply 11 of the top plate 1 via a septum opening 21 of the septum 2. Accordingly each bridging channel 31 of the upper funnel plate 3 is connected to one of the needle funnels for extraction 13 of the top plate 1 via a septum opening 21 of the septum 2. In order to provide a tight connection between the top plate 1, the septum 2 and the upper funnel plate 3, the top plate 1 has recesses 12 around the needle funnels for supply 11 and around the needle funnels for extraction 13 on its under side and the upper funnel plate 3 has ridges 32 around the through holes for supply 33 and the bridging channels 31 on its upper side. When being connected, the septum 2 is pressed into the recesses 12 by the ridges 32.

The filtration plate 4 has alternatingly arranged through holes for extraction 42 and filtration chambers 41, wherein each filtration chamber 41 is connected to one of the through holes for supply 33 of the upper funnel plate 3. Each bridging channel 31 extends through one of the through holes for extraction 42 of the filtration plate 4 projecting below the filtration plate 4.

The filtration plate 4 is connected to the transparent separation layer 5, being again connected to the lower funnel plate 7, wherein a sealing mat 6 is arranged between the transparent separation layer 5 and the lower funnel plate 7. The lower funnel plate 7 has alternatingly arranged through holes for extraction 72 and filtrate funnels 71, wherein each filtrate funnel 71 is connected to one of the filtration chambers 41. Each bridging channel 31 of the upper funnel plate 3 extends again through one of the through holes for extraction 72.

The top of each filtrate funnel 71 is equipped with a filter element 73 having passages of a certain diameter. In the area being adjacent to the filter elements 73 the transparent separation layer 5 has holes (not shown in the figures) having a diameter larger than the diameter of the passages of the filter elements 73. Preferably, each of the filter elements 73 is arranged as a round metal mesh being inserted into a widened top part of the corresponding filtrate funnel 71 and being compressed with the widened top part of the corresponding filtrate funnel 71. Also, each metal mesh is preferably reversed around the filtrate funnel 71 at its lateral end section such that the metal mesh is press fitted with the lower funnel plate 7. Preferably, the pore size of the filter element is about 1 μm to about 2 μm.

The lower funnel plate 7 is connected to the collecting plate 8, wherein a sealing mat 6 is arranged in-between. The collecting plate 8 has collecting wells 81 with elongated cross-sections having the form of rounded rectangles. Each of said collecting wells 81 is connected to one filtrate funnel 71 of the lower funnel plate 7 and to one bridging channel 31 of the upper funnel plate 3. The bottoms of the collecting wells 81 are slightly slanted and well rounded, wherein each collecting well 81 has a deepest point 811 lying essentially straight below the bridging channel 31 being connected to said collecting well 81.

Figure 4:
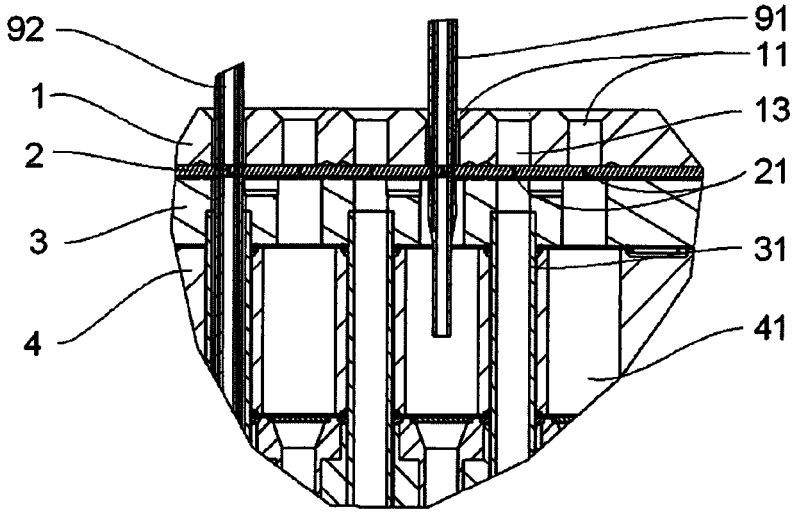
FIG. 4 shows an expanded view of a part of the cross-section view from FIG. 2, where a supply needle penetrates a septum.

In use, one of the septum openings 21 being connected to one of the filtration chambers 41 is penetrated by a supply needle 91, such that the supply needle 91 extends into said filtration chamber 41. As best seen in FIG. 4, the supply needle 91 has a tapered portion for accommodating the septum opening 21 of the septum 2. Again in use, the supply needle 91 supplies a suspension into the filtration chamber 41 thereby creating an overpressure inside the filtration chamber 41 in order to drive the suspension through the filter element 73 into the collecting well 81. The overpressure can be provided by pressure means of the supply needle 91. In particular, when the suspension comprises a solution as the liquid phase, said overpressure provision for driving the filtration has the advantage that crystal formation in the suspension is low compared to driving filtration by creating a vacuum in the collecting well 81. Therefore it is possible to get a filtrate with a comparably high concentration of solute without interfering seeds.

Again to be able to have a high concentration of solute in the suspension, parts of the multi-well filtration device being possibly in contact with the suspension are preferably made of an isolating material, such that the cooling of the suspension being filtered at an elevated temperature is as low as possible.

For preventing an elevated pressure inside the collecting well 81 which can obstruct the supply of suspension into the filtration chamber 41, the supply needle 91 has a longitudinal groove being connected to the according pressure equalization channel 34. Thus, the pressure can be equalized between the collecting well 81 and the air pressure outside the multi-well filtration device.

The filter element 73 retains solids of the supplied suspension, which are not able to pass the passages. Thereby a filter cake is built on top of the transparent separation layer 5. The diameter of the holes of the transparent separation layer 5 is large enough not to essentially effect the filtration and in the meantime it is small enough to be able to hold back the filter cake.

For extracting the filtrate out of the collecting well 81, the septum opening 21 being connected to the according bridging channel 31 is penetrated by an extraction needle 92, such that it extends near the deepest point 811 of the bottom of the collecting well 81. Since the bottom of the collecting well 81 is slightly slanted and well rounded, the filtrate can then efficiently be extracted preventing a comparably high dead volume of filtrate in the collecting well 81.

After filtration, the filtration plate 4 can easily be separated from the lower funnel plate 7 by means of the transparent separation layer 5. The filter cake containing crystals and other solids to be analyzed is still held inside the filtration chambers 41 by the transparent separation layer 5. Without any laborious preparation steps the filter cake can be transferred into an analysis device and it can be analyzed through the transparent separation layer 5 by an appropriate analysis method, such as X-ray powder diffraction or infrared and Raman spectroscopy.

Figure 5:
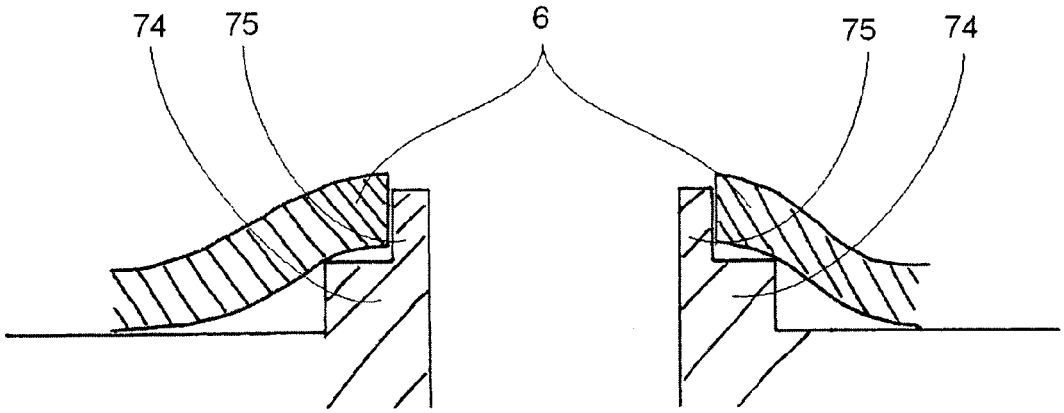
FIG. 5 shows a two-step stair-shaped elevation for receiving a sealing mat of the multi-well filtration device from FIG. 1.

FIG. 5 shows a two-step stair-shaped elevation for receiving a sealing mat 6. In order to provide a seal connection between two adjacent openings of two layers, i.e. through holes, funnels and channels, using common flat sealing mats 6, the border around one of the two openings has preferably a two-step stair-shaped elevation. The sealing mat 6 is lifted and arranged on top of a sealing ridge 74 touching a guiding ridge 75. Thus, the sealing mat 6 is lifted around the opening and when the two layers are connected it is compressed in said lifted area.

Figure 6:
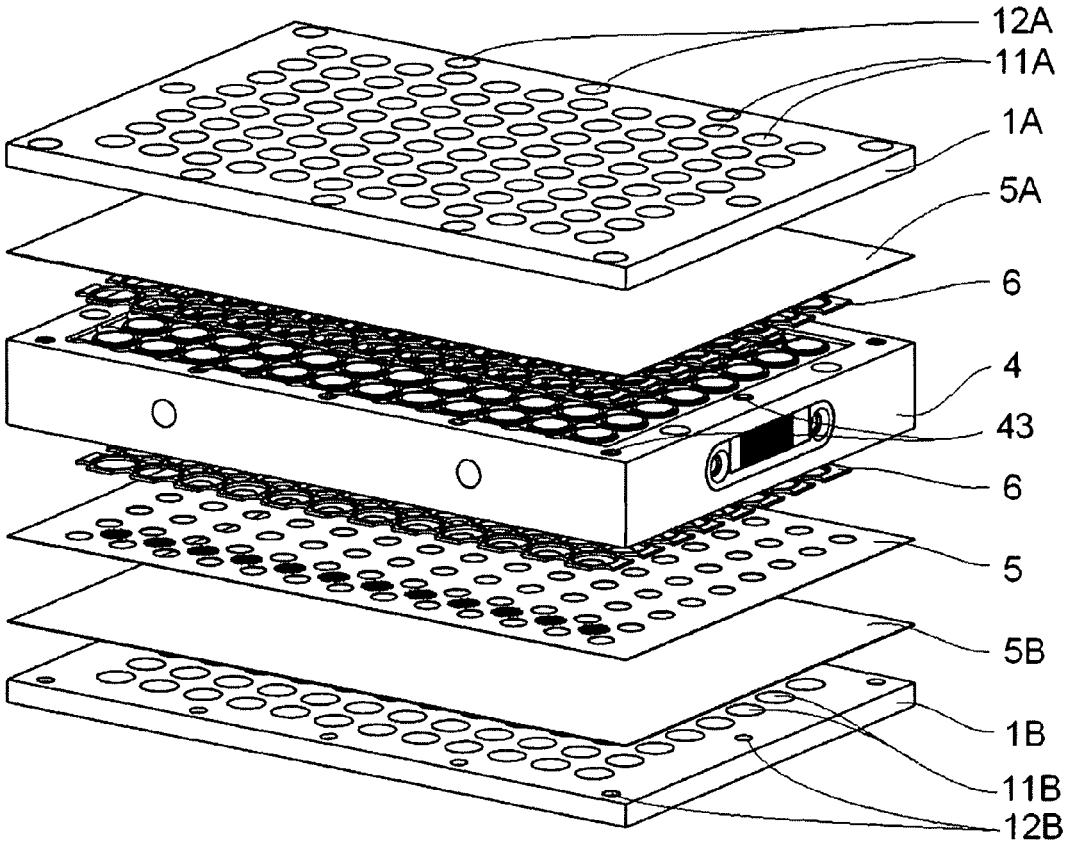
FIG. 6 shows an exploded perspective view of a transfer unit for the multi-well filtration device from FIG. 1.
Figure 7:
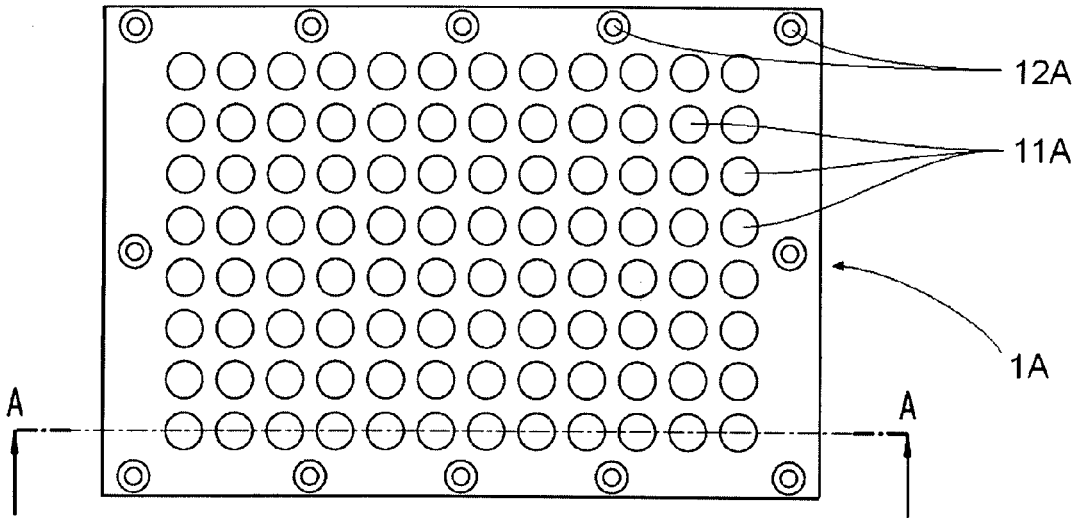
FIG. 7 shows a top view on the transfer unit from FIG. 6.
Figure 8:
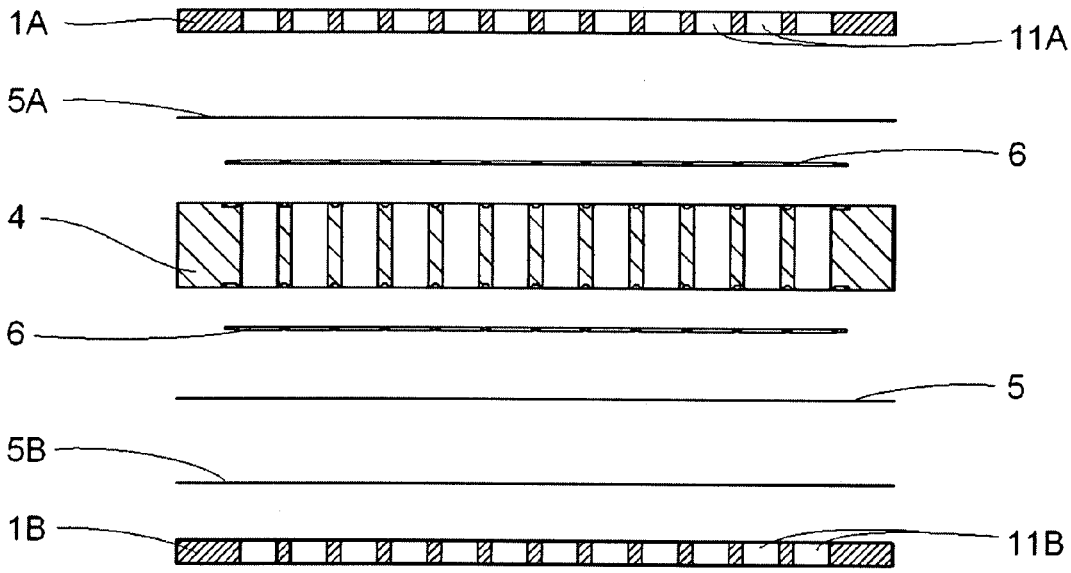
FIG. 8 shows an exploded cross-section view along the line A-A of the transfer unit from FIG. 7.

In FIG. 6, FIG. 7 and FIG. 8 a transfer unit is shown comprising the filtration plate 4 with the two adjacent sealing mats 6 and the separation layer 5. On top of the upper sealing mat 6 a closing layer 5A followed by a top plate 1A are arranged. Accordingly, a closing layer 5B followed by a bottom plate 1B are arranged below the separation layer 5.

After filtration, the filtration layer 4 together with the two adjacent sealing mats 6 and the separation layer 5 can easily be separated from rest of the multi-well filtration device as described above. The filtration plate 4 can then be closed as well as at its upper surface as at its bottom surface by closing layers 5A and 5B followed by a top plate 1A or a bottom plate, respectively. In this state, the top plate 1A can be firmly connected to the bottom plate 1B in order to form a compact transfer unit. For the firm connection the top plate 1A is provided with screw holes 12A, the filtration plate 4 is provided with screw holes 43 and the bottom plate 1B is provided with screw holes 12B, such that the top plate 1A can be firmly connected to the bottom plate 1B by means of screws extending through said screw holes 12 A, 43 and 12B.

The transfer unit, still comprising the filter cakes inside the filtration chambers 41 of the filtration plate 4, can then be comfortably moved, stored or transferred to the according analysis device. Preferably, the upper plate 1A and the bottom plate 1B are provided with through holes 11A and 11B being arranged adjacent to the filtration chambers 41 as well as the closing layers 5A and 5B are made of a transparent material, such that the filter cakes can be analyzed through the through holes 11A and 11B and the closing layers 5A and 5B by an appropriate analysis method, such as X-ray powder diffraction or infrared and Raman spectroscopy.

Other alternative embodiments of the multi-well filtration device according to the invention are conceivable. Explicitly mentioned in this context are:

The wells, funnels and through holes of the different layers can be arranged in any other suitable structure, in particular in a standardized 384 or 1536 wells microplate compliant structure.

The transfer unit can also be formed of the described closing layers, the top plate and the bottom plate together with another appropriate multi-well plate than the filtration plate in between.

To be particularly suitable for x-ray analysis, the separation layer can be made of an amorphous fluoropolymer, in particular of an amorphous fluoropolymer as it is known by persons skilled in the art as Teflon AF.

What is claimed is:

1. A system for analyzing a solid phase of a suspension comprising a liquid phase and a solid phase, the system comprising:

a multi-well filtration device comprising:

a filtration plate with a filtration chamber;

a collecting plate with a collecting well, wherein the filtration chamber is connected to the collecting well;

a filter element arranged between the filtration chamber and the collecting well; and a separate separation layer arranged between the filtration plate and the collecting plate adjacent to and atop the filter element relative to a direction of flow of the liquid phase of the suspension, the separate separation layer being provided with holes having a diameter large enough not to essentially affect the filtration and small enough to be able to hold back a filter cake formed by the solid phase, wherein as a result of filtration of the solid phase from the suspension by the filter element, the filter cake is formed on top of the separate separation layer;

a supply needle for supplying the suspension into the filtration chamber on an elevated pressure level;

an extraction needle for extracting the filtrate out of the collecting well; and an analysis device arranged for analyzing the solid phase filtered by the multi-well filtration device through the separate separation layer, while the solid phase is situated in the filtration chamber.

2. The system of claim 1, wherein the supply needle has a longitudinal groove for performing equalization of pressure in the collecting well while the supply needle is supplying the suspension into the filtration chamber.

3. A method for analyzing a solid phase of a suspension comprising a liquid phase and a solid phase, the system comprising the steps of:

supplying the suspension into a filtration chamber of a filtration plate on an elevated pressure level by means of a supply needle, thereby driving the suspension from the filtration chamber through a filter element and into a collecting well of a collecting plate, wherein a separate separation layer is arranged between the filtration plate and the collecting plate adjacent to and atop the filter element relative to a direction of flow of a liquid phase of the suspension, wherein as a result of filtration of the solid phase from the suspension by the filter element, a filter cake is formed on top of the separate separation layer;

removing the filtration plate together with the separate separation layer from the collecting plate;

transferring the filtration plate to an analysis device; and analyzing the solid phase through the separate separation layer while the solid phase is situated in the filtration chamber.

4. The method of claim 3, wherein the separate separation layer is provided with holes having a diameter large enough not to essentially affect the filtration and small enough to be able to hold back a filter cake formed by the solid phase.

5. A multi-well filtration device for filtering a suspension comprising a liquid phase and a solid phase, the device comprising:

a filtration plate with a filtration chamber;

a collecting plate with a collecting well, wherein the filtration chamber is connected to the collecting well;

a filter element for filtering the solid phase from the suspension, the filter element being arranged between the filtration chamber and the collecting well;

a separate separation layer arranged between the filtration plate and the collecting plate adjacent to and atop the filter element relative to a direction of flow of the liquid phase of the suspension, the separate separation layer being provided with holes having a diameter large enough not to essentially affect the filtration and small enough to be able to hold back a filter cake formed by the solid phase, wherein as a result of filtration of the solid phase from the suspension, the filter cake is formed on top of the separate separation layer;

a lower funnel plate which is arranged between the filtration plate and the collecting plate, wherein the lower funnel plate has a filtrate funnel connecting the filtration chamber with the collecting well;

an upper funnel plate with a bridging channel, wherein the filtration plate has a through hole for extraction which is connected to the collecting well;

a top plate with a needle funnel; and a pierceable septum with a septum opening, wherein:

the filter element is arranged at the top of the filtrate funnel, the bridging channel extends through the through hole for extraction into the collecting well, such that the upper funnel plate is connected with the collecting plate via the bridging channel, and the septum is arranged between the top plate and the upper funnel plate or the filtration plate, respectively, such that the needle funnel is connected to the filtration chamber and that the septum opening is arranged adjacent to the needle funnel.

6. The multi-well filtration device of claim 5, wherein the top plate has a recess around the needle funnel on the side facing the septum and the upper funnel plate or the filtration plate, respectively, has a corresponding ridge on the side facing the septum, such that the septum is pressed into the recess by the ridge.

7. The multi-well filtration device of claim 5, further comprising a pressure equalization channel for equalizing the pressure in the collecting well.

8. The multi-well filtration device of claim 7, wherein a sealing mat is arranged between two adjacent plates, the sealing mat having a hole located corresponding to adjacent openings of the two plates and one of the two adjacent plates having a sealing ridge on the side facing the sealing mat capable of receiving the border of the hole on top of the sealing ridge.

* * * * *